US005146742A

United States Patent [19]

Iida et al.

[11] Patent Number: 5,146,742

[45] Date of Patent: Sep. 15, 1992

[54] ION THRUSTER FOR INTERPLANETARY SPACE MISSION

[75] Inventors: Hiroshi Iida; Kyoichi Kuriki; Hitoshi Kuninaka, all of Tokyo, Japan

[73] Assignee: NEC Corporation, Tokyo, Japan

[21] Appl. No.: 606,984

[22] Filed: Oct. 31, 1990

[30] Foreign Application Priority Data

Oct. 31, 1989 [JP] Japan ..... 1-285815
Oct. 31, 1989 [JP] Japan ..... 1-285816

[51] Int. Cl.[5] ..... F03H 1/00

[52] U.S. Cl. ..... 60/202; 313/362.1; 315/111.81; 60/203.1

[58] Field of Search ..... 60/202, 200.1, 203.1; 313/362.1, 230; 315/111.81, 111.91

[56] References Cited

U.S. PATENT DOCUMENTS

| | | | |
|---|---|---|---|
| 3,114,517 | 12/1963 | Brown | 60/203.1 |
| 3,757,518 | 9/1973 | Bahr | 60/202 |
| 3,866,414 | 2/1975 | Bahr | 60/202 |
| 3,913,320 | 10/1975 | Reader et al. | 60/202 |
| 4,038,557 | 7/1977 | Gildersleeve, Jr. et al. | 60/203.1 |
| 4,209,703 | 6/1980 | Delcroix et al. | 60/202 |
| 4,507,588 | 3/1985 | Asmussem et al. | 313/362.1 |
| 4,684,848 | 8/1987 | Kaufman et al. | 315/111.91 |
| 4,727,293 | 2/1988 | Asmussen et al. | 315/111.81 |
| 4,780,642 | 10/1988 | Jacquot | 315/111.81 |
| 4,873,467 | 10/1989 | Kaufman et al. | 60/202 |
| 4,906,900 | 3/1990 | Asmussen | 313/362.1 |

*Primary Examiner*—Richard A. Bertsch
*Assistant Examiner*—Michael I. Kocharov
*Attorney, Agent, or Firm*—Sughrue, Mion, Zinn, Macpeak & Seas

[57] ABSTRACT

An ion thruster is operable in an interplanetary space with plasma generated by microwaves in a propellant atmosphere. A vessel defines first, second and third hollow spaces and a window between the first hollow space and the second and third hollow spaces, the second hollow space having an opening. A microwave generating unit generates the microwave in the first hollow space as a standing wave penetrating into the second and thid spacers hollow. A propellant supplying unit supplies the propellant into the second and third hollow spaces, the propellant serving as a main and neutralizing propellant and absorbing the standing wave to produce main plasma comprising main ions and main elecrons. An accelerating unit accelerates only the main ions into an ion beam to inject the ion beam through the opening into the interplanetary space. A neutralizing unit defines a third space which is in communication to the first space and into which the standing wave penetrates. The propellant comes into the third space to produce neutralizing ions and electrons. The ions are pulled by the ion beam to leave the neutralizing electrons, which neutralize the vessel.

4 Claims, 3 Drawing Sheets

ION THRUSTER FOR INTERPLANETARY SPACE MISSION

BACKGROUND OF THE INVENTION

This invention relates to an ion thruster which may be used, for example for interplanetary space missions.

A conventional ion thruster comprises a vessel, a cathode unit adjacent to the vessel, and a propellant supplying unit connected to the vessel. The cathode unit comprises a hollow cylindrical cathode. The vessel defines a hollow space with an open end and includes an anode. An electrical potential is supplied between the anode and the vessel.

The cathode unit emits thermoelectrons into the hollow space.

The propellant supplying unit supplies a propellant into the hollow space to form a propellant atmosphere in the hollow space.

The thermoelectrons in the thermal atmosphere are accelerated by the electrical potential between the anode and the cathode and come into collision with the propellant to produce plasma which comprises plasma ions and plasma electrons.

An accelerating unit is placed at the opening. The accelerating unit accelerates only the main plasma ions to form and inject an ion beam through the opening towards space.

Alternatively, plasma may be generated in an inert gas atmosphere using microwaves. The inert gas atmosphere may be attained by introducing an inert gas into a hollow space.

It should be noted, however, in connection with the conventional ion thruster, that the cathode must be preheated before operation so that a quick start is possible. Furthermore it, is difficult to prolong the life of the ion thruster because degradation of the electrodes is unavoidable.

SUMMARY OF THE INVENTION

It is therefore an object of the present invention to provide an ion thruster for producing plasma without the need for electrodes.

It is another object of this invention to provide an ion thruster of the type described and having a simple structure.

It is a still another object of this invention to provide an ion thruster of the type described and having a prolonged life.

It is a yet another object of this invention to provide an ion thruster of the type described and having a high propulsion capability.

Other objects of this invention will become clear in view of the description below.

In accordance with this invention, there is provided an ion thruster which is operable for interplanetary space missions and which comprises a vessel defining first, second and third hollow spaces and a window between the first hollow space and the second and third hollow spaces. The second hollow space has an open end. Microwaves are generated by a microwave generating unit and are transmitted into the first hollow space. The first hollow space is operable as a cavity resonator for the microwave so that a standing wave is produced in the first hollow space to penetrate and induce electric field power into the second and third hollow spaces through the window. A propellant supplying unit supplies a main propellant into the second and third hollow spaces, the propellant serving as a main and neutralizing propellant in the second and third spaces. The main propellant absorbs the electric field power to produce main plasma ion and main plasma electrons in the second hollow space. An accelerating unit is positioned adjacent to the opening and accelerates only the main plasma ions to form and inject an ion beam through the opening into the space. The third space serves as a neutralizing means for neutralizing the vessel by using electrical field power induced in the third hollow space and the neutralizing propellant.

DESCRIPTION OF THE PREFERRED EMBODIMENTS

Figure 1:
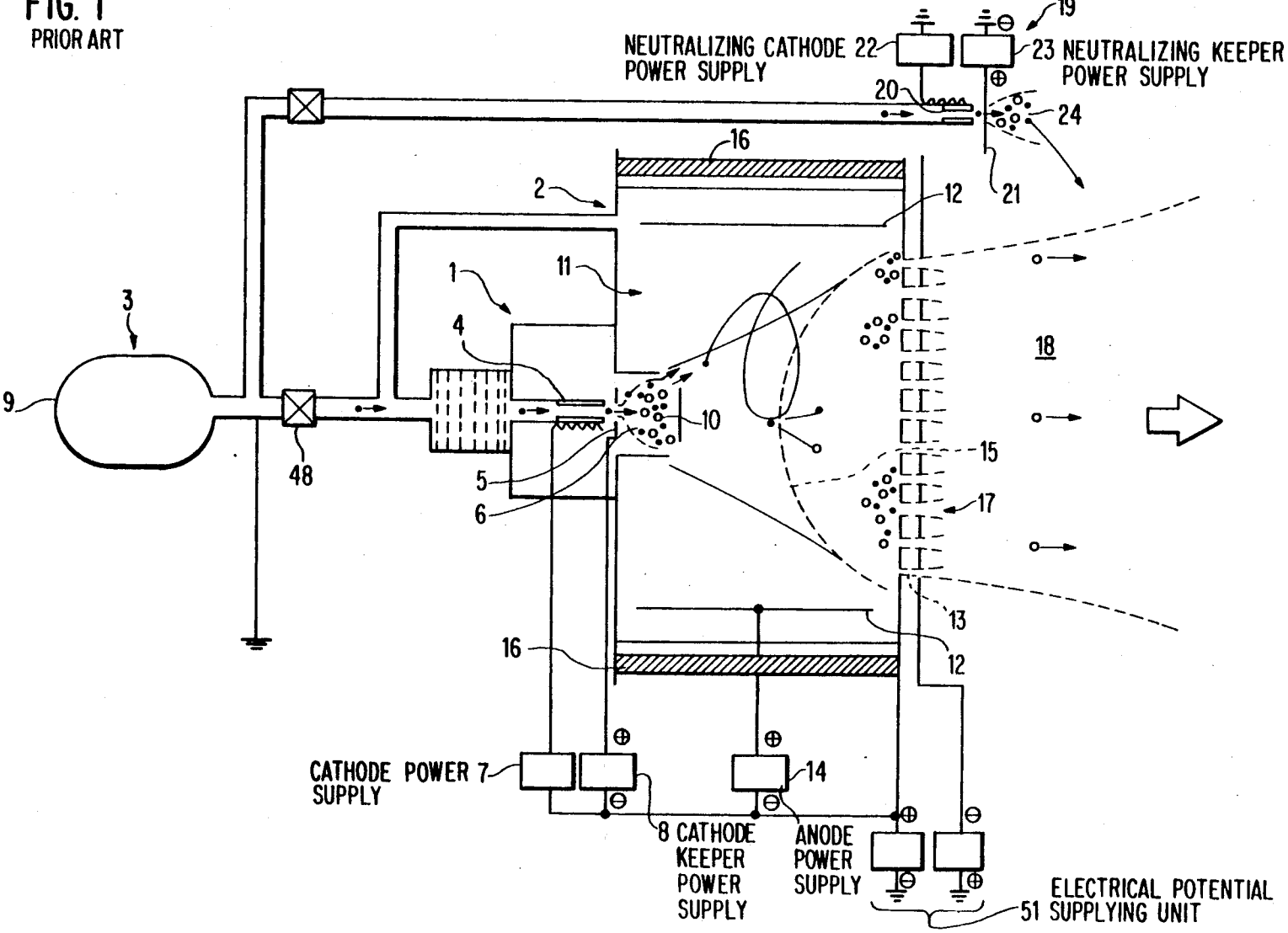
FIG. 1 PRIOR ART
FIG. 1 is a schematic cross-sectional view of a conventional ion thruster.

Referring to FIG. 1, a conventional ion thruster will be described first, in order to facilitate an understanding of this invention. The conventional ion thruster comprises a vessel 2, a cathode unit 1 adjacent to the vessel 2, and a propellant supplying unit 3 connected to the vessel 2 directly and through the cathode unit 1. The vessel 2 defines a main discharge space 11.

The cathode unit 1 comprises a hollow cylindrical cathode 4 and a cathode keeper 5 having an opening colinear with the cylindrical cathode 4. The cathode unit 1 defines a cathode hollow space 6 connected to the main discharge space 11.

The hollow cylindrical cathode 4 is connected to a cathode power supply 7. The cathode keeper 5 is connected to a cathode keeper power supply 8.

The propellant supplying unit 3 comprises a propellant supplying tank 9 for supplying a main propellant into the main discharge space 11. The propellant supplying tank 9 is connected to the vessel 2 directly and through the cathode hollow space 6.

The hollow cylindrical cathode 4 is heated by the cathode power supply 7 to emit thermoelectrons. The cathode keeper power supply 8 produces electric discharge between the hollow cylindrical cathode 4 and the cathode keeper 5. The electric discharge generates a cathode hollow plasma 10 in the cathode space 6 by the use of the thermoelectrons and the propellant. The cathode plasma 10 comprises cathode plasma electrons.

The main discharge space 11 includes an anode 12 and an opening 13. The anode 12 is connected to an anode power supply 14 for accelerating the cathode plasma electrons as accelerated electrons from the cathode hollow space 6 towards the anode 12 in the main discharge space 11.

The accelerated electrons collide with the main propellant in the main discharge space 11 to produce main plasma 15. The main plasma comprises main ions and main electrons.

The vessel 2 is surrounded by a magnetic field supplying unit 16. The magnetic field supplying unit 16 produces a magnetic field in the main hollow discharge space 11 to induce a spiral movement in the accelerated electrons. The spiral movement is useful in prolonging the travel length of the electrons towards the anode 12 thereby increasing the probability of collisions between the main propellant and the accelerated electrons.

An accelerating unit 17 is positioned at the opening 13. The accelerating unit 17 accelerates only the main plasma ions to form and inject an ion beam 18 through the opening 13 into the surrounding space.

The conventional ion thruster further comprises a neutralizing unit 19. The neutralizing unit 19 is supplied with the main propellant as a neutralizing propellant from the propellant supplying unit 3 and comprises a neutralizing cathode 20 and a neutralizing keeper 21 having an opening colinear with the neutralizing cathode 20.

The neutralizing cathode 20 and the neutralizing keeper 21 are connected to a neutralizing cathode power supply 22 and a neutralizing keeper power supply 23.

The neutralizing cathode 20 is heated by the neutralizing cathode power supply 22 to emit neutralizing thermoelectrons. The neutralizing keeper power supply 23 produces neutralizing electric discharge between the neutralizing cathode 20 and the neutralizing keeper 21. The neutralizing electric discharge generates a neutralizing plasma 24 by the use of the neutralizing thermoelectrons and the neutralizing propellant. The neutralizing plasma 24 comprises neutralizing ions, neutralizing electrons, and thermoelectrons. The thermoelectrons are pulled by the ion beam from the opening of the neutralizing keeper 21 for neutralization.

Figure 2:
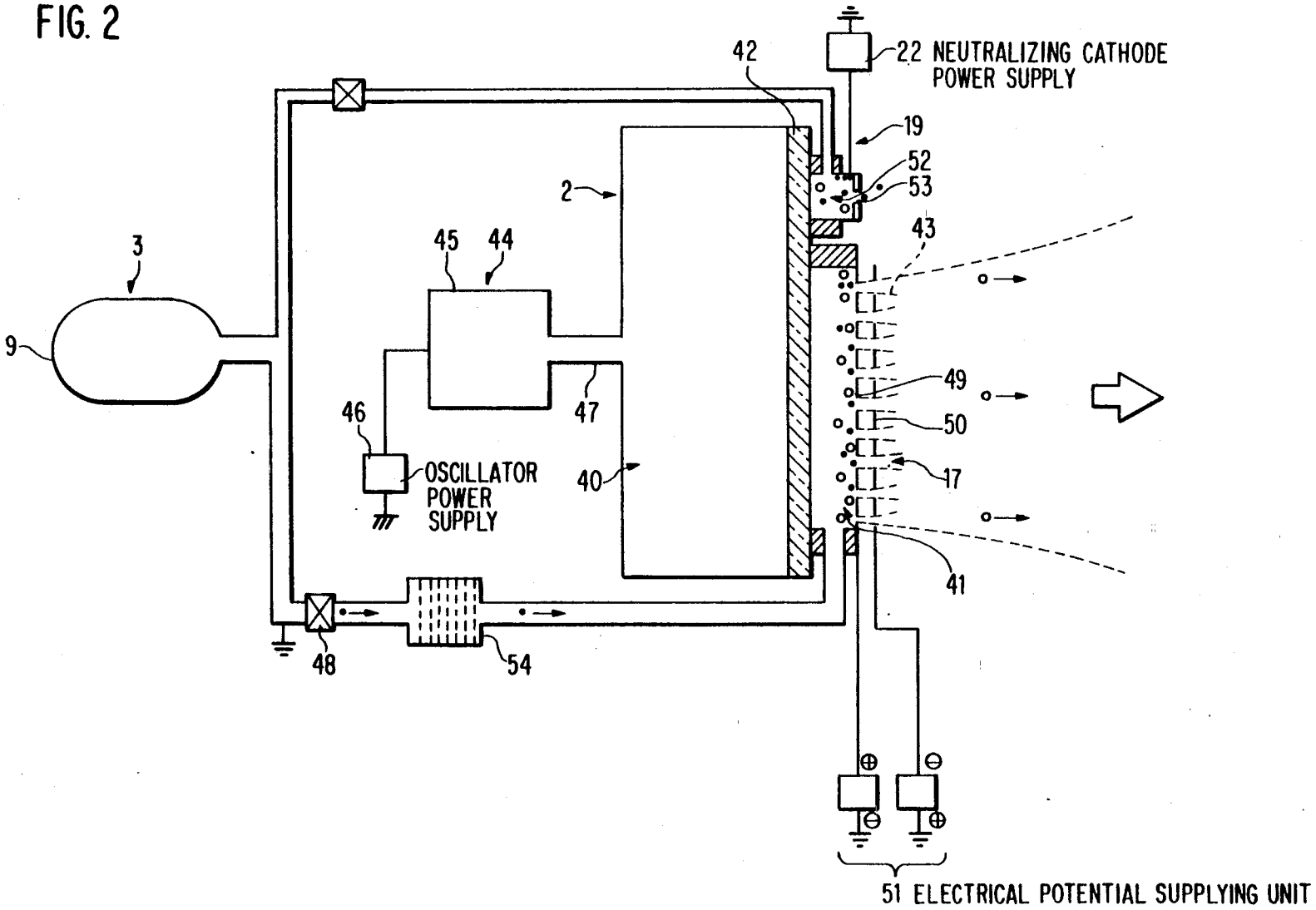
FIG. 2 is a schematic, cross-sectional view of an ion thruster according to a preferred embodiment of the present invention.

FIG. 2 shows an ion thruster according to a preferred embodiment of the present invention. Parts which are similar to those of the conventional art are designated by like reference numerals.

The vessel 2 defines a first, second and third hollow spaces 40, 41 and 52, and a window 42 between the first hollow space 40 and the second and third hollow spaces 41, 52. A quartz plate may be placed at the window 42. The second hollow space 41 has an opening 43 opposite to the quartz plate 42.

The ion thruster further comprises a microwave generating unit 44 connected to the vessel 2. The microwave generating unit 44 comprises a microwave oscillator 45, an oscillator power supply 46, and a waveguide 47. The microwave oscillator 45 is energized by the oscillator power supply 46 and produces microwaves which propagate into the first hollow space 40 through the waveguide 47.

The first hollow space 40 is operable as a cavity resonator for the microwaves so that a standing wave is produced in the first hollow space 40 to penetrate and induce electric field power into the second and third hollow spaces 41 through the quartz plate 42, 52.

Figure 3:
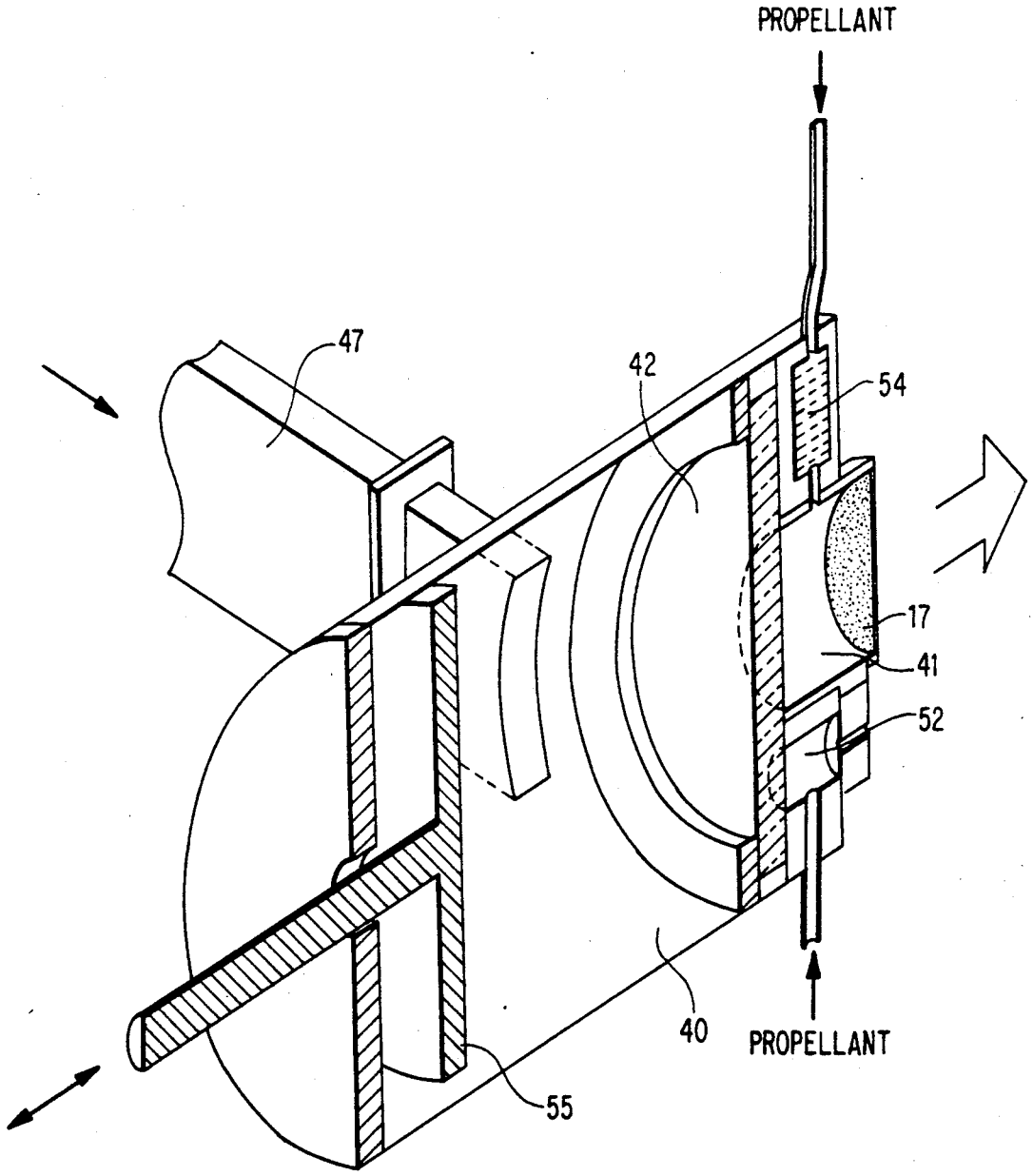
FIG. 3 is a schematic perspective and sectional view of the ion thruster depicted in FIG. 2.

Turning to FIG. 3, the first hollow space 40 has a length which is adjustable through the use of a plunger 55 to thereby function as a cavity resonator.

Turning back to FIG. 2, the propellant supplying tank 9 is connected to the second and third hollow spaces 41, 52. A main flow controller 48 controls the main propellant flow. Therefore, the main propellant is supplied into the second and third hollow spaces 41, 52 and absorbs the electric field power to produce main plasma in the second hollow space 41.

The accelerating unit 17 accelerates only the main ions to form and inject an ion beam through the opening 43 into the surrounding space. Specifically, the accelerating unit 17 comprises first and second grid electrodes 49 and 50 at the opening 43. The first grid electrode 49 is contiguous to the second hollow space 41. The second grid electrode 50 is positioned away from the second hollow space 41. The accelerating unit 17 further comprises an electric potential supplying unit 51. The electric potential supplying unit 51 supplies an electrical potential difference between the first and the second grid electrodes 49 and 50 such that the first grid electrode 49 has a higher potential ranging from 1 kV to 2 kV, and the second grid electrode 50 has a lower potential of approximately −500 V.

The ion thruster further comprises a neutralizing unit which is somewhat different from the neutralizing unit 19 described with reference to FIG. 1 but will be designated by the same reference numeral 19. Specifically, the neutralizing unit 19 comprises the neutralizing cathode 20 in the manner described in conjunction with FIG. 1. Heated by the heating power supply 22, the neutralizing cathode 20 produces thermoelectrons for use in neutralizing the vessel 2. The neutralizing keeper 21 and the neutralizing keeper supply 23 of the conventional art, however, are unnecessary.

Alternatively and more preferably, the neutralizing unit 19 defines a third hollow space 52 connected to the first hollow space 40 through the quartz plate 42 for the microwave and ends at an orifice 53. The standing wave penetrates and induces electric field power into the third hollow space 52 through the quartz plate 42. The propellant supplying tank 3 supplies the propellant into the third hollow space 52. The neutralizing propellant absorbs the electric field power to produce the neutralizing plasma in the third hollow space 52. The neutralizing electrons are pulled by the ion beam through the orifice 53.

In other words, the microwave generating unit 44 can generate simultaneously the main plasma and the neutralizing plasma in the vessel 2 and in the neutralizing unit 19, respectively.

Therefore, the ion thruster comprises a drastically reduced number of power suppliers and electrodes so as to reduce the total weight and improve the reliability of the ion thruster.

The quartz plate 42 is operable as a protection wall for diffusion of the main propellant and the main plasma towards the second hollow space 41. If desired, it is possible not to use the quartz plate 42 but to leave the window 42 open. This is because the main propellant and the main plasma do not appreciably diffuse into the second hollow space 41 even when the window 42 is left open. An insulator 54 insulates the vessel 2 from the propellant supplying unit 3, and consists of a plurality of wire nets. This is because the insulation is necessary since the main plasma potential is approximately 1 kV and, therefore, there is a large difference in potential between the main plasma and the propellant supplying unit 3. An optimum density is approximately $10^{11}$ $cm^{-3}$ which is achieved when the microwave is used before generating plasma for ion thrusters.

What is claimed is:

1. An ion thruster which is operable for interplanetary space travel and comprises:

a vessel defining first, second, and third hollow spaces and a window between said first hollow space and said second and said third hollow spaces, said second hollow space having an opening open to a surrounding space;

microwave generating means for generating microwaves in said first hollow space, said first hollow space being operable as a cavity resonator for said microwaves so that a standing wave is produced in said first hollow space to penetrate into said second and said third hollow spaces through said window and to induce electric field power in said second and said third hollow spaces;

propellant supplying means for supplying a propellant to said second and said third spaces, said propellant serving as a main and a neutralizing propellant in said second and said third hollow spaces, respectively, said main propellant absorbing said electric field power to produce main plasma ions and main plasma electrons in said second hollow space; and accelerating means adjacent to said opening for accelerating only said main plasma ions to form an ion beam and to inject said ion beam to said surrounding space through said opening;

said third space serving as neutralizing means for neutralizing said vessel by using the electric field power induced in said third hollow space and said neutralizing propellant.

2. An ion thruster as claimed in claim 1, wherein said third hollow space ends at an orifice open to said surrounding space adjacent to said opening, said normalizing propellant absorbing said electric field power to produce neutralizing plasma ions, neutralizing plasma electrons, and thermoelectrons in said third hollow space, said thermoelectrons being pulled through said orifice by the ion beam injected into said surrounding space, said neutralizing plasma ions and said neutralizing plasma electrons being left in said third hollow space to neutralize said vessel.

3. An ion thruster as claimed in claim 1, wherein said accelerating means comprises a first and a second grid electrode at said opening, said first grid electrode being contiguous to said second hollow space, said second grid electrode being positioned from said second hollow space, said accelerating means further comprising electric potential supplying means for supplying an electrical potential difference between said first and said second grid electrodes with said first grid electrode made to have a higher potential than said second grid electrode.

4. An ion thruster as claimed in claim 1, wherein said window is closed by a quartz plate.

* * * * *